US005486735A

United States Patent [19]

Kamohara et al.

[11] Patent Number: 5,486,735

[45] Date of Patent: Jan. 23, 1996

[54] ELECTRON GUN WITH IMPROVED WITHSTAND VOLTAGE FOR COLOR-PICTURE TUBE

[75] Inventors: Eiji Kamohara, Fukaya; Shigeru Sugawara, Saitama; Junichi Kimiya, Fukaya, all of Japan

[73] Assignee: Kabushiki Kaisha Toshiba, Kawasaki, Japan

[21] Appl. No.: 143,646

[22] Filed: Nov. 1, 1993

[30] Foreign Application Priority Data

Nov. 2, 1992 [JP] Japan ..... 4-294374

[51] Int. Cl.[6] ..... H01J 29/51

[52] U.S. Cl. ..... 313/414; 313/412; 313/460

[58] Field of Search ..... 313/412, 413, 313/414, 460, 458

[56] References Cited

U.S. PATENT DOCUMENTS

| | | | |
|---|---|---|---|
| 2,957,106 | 10/1960 | Moodey | 313/414 |
| 3,772,554 | 11/1973 | Hughes | 313/414 |
| 4,086,513 | 4/1978 | Evans, Jr. | 313/414 |
| 4,887,001 | 12/1989 | D'Amato et al. | 313/461 |
| 4,897,575 | 1/1990 | Shimoma et al. | 313/414 |
| 5,034,652 | 7/1991 | Shimona et al. | 313/414 |

FOREIGN PATENT DOCUMENTS

| | | | |
|---|---|---|---|
| 0157648 | 10/1985 | European Pat. Off. | H01J 29/50 |
| 0302657 | 2/1989 | European Pat. Off. | H01J 29/50 |
| 0333488 | 9/1989 | European Pat. Off. | H01J 29/50 |
| 60-7345 | 2/1985 | Japan | H01J 29/56 |
| 64-38947 | 2/1989 | Japan | H01J 29/50 |
| 1-236554 | 9/1989 | Japan | H01J 29/50 |

OTHER PUBLICATIONS

Patent Abstracts of Japan, vol. 3, No. 2 (E–83) 13 Jan. 1979 & JP–A–53 129 579 (Matsushita Denki Kogyo K.K.) 11 Nov. 1978 *abstract*.

*Primary Examiner*—Donald J. Yusko
*Assistant Examiner*—Michael Day
*Attorney, Agent, or Firm*—Cushman Darby & Cushman

[57] ABSTRACT

Disclosed is a color cathode ray tube equipped with a main electronic lens section for focusing a plurality of in-line electron beams on a screen section. The main electronic lens section includes a plurality of grids each having electron-beam through holes and securely supported by a plurality of insulating supports. At least one of the grids has a rectangular cup portion with a substantially rectangular cross section for commonly enclosing the plurality of in-line electron beams and a face having electron-beam through holes formed at least at one end and substantially perpendicular to the rectangular cup portion. The ratio of an outside diameter $L_H$ of the substantially rectangular portion in a long-axial direction to an outside length $L_S$ thereof in a short-axial direction, $L_H/L_S$, is set to $2.5<L_H/L_S<4.4$, and the ratio of the outside length $L_S$ to a diameter $D_V$ of the electron-beam through holes in the same short-axial direction, $L_S/D_V$, is set to $1.0<L_S/D_V<2.1$. This design can improve the withstand voltage characteristic and the focusing characteristic of the CRT.

7 Claims, 9 Drawing Sheets

ELECTRON GUN WITH IMPROVED WITHSTAND VOLTAGE FOR COLOR-PICTURE TUBE

BACKGROUND OF THE INVENTION

1. Field of the Invention

The present invention relates to a color cathode ray tube (CRT) apparatus, and, more particularly, to a color CRT apparatus equipped with an electron gun which is designed to improve the withstand voltage characteristic and the focusing characteristic of the CRT.

2. Description of the Related Art

FIG. 1 shows the cross section of a typical color CRT apparatus. As shown in FIG. 1, a color CRT apparatus 1 is equipped with a vacuum envelope having a panel 3 with a phosphor screen 2, a funnel 4 extending from this panel 3, and a neck 5 coupled via this funnel 4 with the panel 3. An electron gun 6 is disposed inside the neck 5 of the vacuum envelope. A deflection yoke 7 is attached to the outer surface of the vacuum envelope which extends from the neck 5 to the funnel 4. A shadow mask 9 having a number of apertures 8 is disposed facing the inner wall of the phosphor screen 2 with a predetermined interval therebetween. An internal conductive film 10 is evenly coated on the inner wall of the vacuum envelope between the funnel 4 to a part of the neck 5. An outer conductive film 11 is coated on the outer surface of the funnel 4, with an anode terminal (not shown) provided at a part of the funnel 4.

A red fluorescent material, a green fluorescent material, and a blue fluorescent material are coated at many positions in a stripe or dot form, and three electron beams BR, BG, and BB launched from the electron gun 6 are properly selected by the shadow mask 9 to hit the respective fluorescent materials, causing the fluorescent materials to luminesce. The electron gun 6 has an electron-beam generating section GE, which generates three parallel in-line electron beams, and at the same time, controls and accelerates those electron beams, and a main electronic lens section ML, which converges and focuses those three electron beams. The three electron beams are deflected by the deflection yoke to scan the entire phosphor screen, showing an image on the phosphor screen.

The three electron beams may be converged, for example, by a technique disclosed in the specification of U.S. Pat. No. 2,957,106, wherein slightly inclined, unparallel electron beams, which are launched from the cathodes, are focused due to the inclination. Another technique of focusing the electron beams is disclosed in the specification of U.S. Pat. No. 3,772,554. According to this technique, the openings of some of the three electron-beam through holes formed on both sides of the electrodes in the electron gun are made slightly eccentric to the center axis of the electron gun to thereby converge the electron beams. Both of these techniques are widely employed.

The deflection yoke basically has a horizontal deflection coil for generating a horizontal-deflection magnetic field to deflect an electron beam in the horizontal direction, and a vertical deflection coil for generating a vertical-deflection magnetic field to deflect an electron beam in the vertical direction. When electron beams are deflected, the convergence of the spots of the three electron beams on the phosphor screen of an actual color CRT is shifted so that some measure is taken to prevent the misconvergence. This is called a convergence free (self-convergence type) system, which generates a horizontal-deflection magnetic field of a pin-cushion shape and a vertical-deflection magnetic field of a barrel shape to converge the three electron beams on the entire phosphor screen.

When the deflection magnetic fields are not formed unequal to each other as mentioned above, the resolution at the peripheral portion of the screen of the color CRT is reduced, and this tendency becomes more prominent as the deflection angle increases from 90 degrees to 110 degrees. This reduction in resolution at the peripheral portion of the screen occurs because the focusing is lessened in the horizontal direction by the deflection magnetic field shown in FIG. 2A while the focusing is intensified in the vertical direction by the deflection magnetic field shown in FIG. 2B. Accordingly, a beam spot 20 in the center portion of the screen would have a nearly circular shape while beam spots 21 at the peripheral portion of the screen would have a shape consisting of a high-luminance, horizontally-elongated elliptical core portion 23 and a low-luminance, vertically-elongated elliptical halo portion 24, as shown in FIG. 3.

To reduce the deformation of beam spots at the peripheral portion of the screen so as to improve the resolution, the techniques proposed in, for example, Jpn. Pat. Appln. KOKOKU Publication No. 60-7345 (corresponding U.S. Pat. No. 4,887,001), Jpn. Pat. Appln. KOKAI Publication No. 64-38947 (corresponding U.S. Pat. No. 4,897,575), and Jpn. Pat. Appln. KOKAI Publication No. 1-236554 (corresponding U.S. Pat. No. 5,034,652) are effectively. Particularly, the electron guns described in Jpn. Pat. Appln. KOKAI Publication No. 64-38947 and Jpn. Pat. Appln. KOKAI Publication No. 1-236554 can make the beam spot at the center of the screen smaller. Further, the color CRT described in Jpn. Pat. Appln. KOKAI Publication No. 64-38947 employs a so-called dynamic focusing technique of varying the intensity of the electronic lens of the electron gun in accordance with the amount of deflection to thereby make the deformation of the beam spot at the center of the screen very small. Using this technique, an image of high resolution over the entire screen can be obtained.

As described in the aforementioned KOKAI Publication No. 64-38947, asymmetric electronic lenses are formed in front of and at the back of a normal symmetric cylindrical electronic lens within the lens region. To form such asymmetric electronic lenses, an eaves-shaped electric-field compensating electrode 28 is placed inside a bathtub-shaped electrode 27 as shown in FIG. 4 according to the prior art.

In the color CRT described in Jpn. Pat. Appln. KOKAI Publication No. 64-38947, a resistor is provided inside the neck in the vicinity of the electron gun to supply the potential of a specific electrode of the electron gun, thereby accomplishing good dynamic focusing.

FIGS. 5A and 5B show the cross sections of the electron gun assembly of the prior art. In FIGS. 5A and 5B, an electron gun 6 has three cathodes KR, KG, and KB, each housing a heater (not shown), and arranged in a straight line, a first grid G1, a second grid G2, a third grid G3, a fourth grid G4, and a convergence cup CP. These components are arranged in the named order along the tube axis, and are securely supported by insulating supports MFG.

The grids G1 and G2 are thin plate-shaped electrodes of 0.2-mm in thickness. The grid G1 has three small electron-beam through holes AR1, AG1, and AB1 of about 0.7 mm in diameter bored through it at center distances of 6.6 mm. The grid G2, likewise, has three small electron-beam through holes AR2, AG2, and AB2 of about 0.7 mm in diameter bored through it at center distances of 6.6 mm.

The grid G3 comprises two bathtub-shaped electrodes 27-1 and 27-2 and an eaves-shaped electric-field compensating electrode 28-1 inserted therebetween. Three electron-beam through holes AR3-1, AG3-1, and AB3-1, 1.3 mm in diameter, are bored through the bathtub-shaped electrode 27-1 at the grid-G2 side. Three electron-beam through holes AR3-2, AG3-2, and AB3-2, 6.2 mm in diameter, are bored through the bathtub-shaped electrode 27-2 at the grid-G4 side. As shown in FIG. 6, the cylindrical shape of each of the bathtub-shaped electrodes 27-1 and 27-2 has an outside diameter $L_H$ of 21.3 mm in the long-axial direction and an outside diameter $L_V$ of 9.5 mm in the short-axial direction.

The eaves-shaped portion of the electric-field compensating electrode 28-1 is formed of a flat plate, about 1.2 mm thick, 3.0 mm long, and 19.0 mm wide, extending in parallel to the plane of the path of each electron beam to sandwich that plane.

The grid G4, like the grid G3, comprises two bathtub-shaped electrodes 27-3 and 27-4 and an eaves-shaped electric-field compensating electrode 28-2 inserted therebetween. The cylindrical convergence cup CP is closely attached to the screen side of the grid G4, with a spring BS attached to the outer surface of the distal end of the convergence cup. The spring BS is pressed against a conductive film 10 coated on the inner wall of the neck 5. The convergence cup CP is a cylinder with an open end, 0.32 mm in thickness and 22.0 mm in diameter, and has three electron-beam through holes formed through its bottom in association with the electron-beam through holes of the bathtub-shaped electrode 27-4 of the grid G4.

The components from the cathodes to the grid G4 are securely supported by the insulating supports MFG and are accommodated in the neck 5 having an inside diameter of 23.9 mm. Those electrodes are designed slightly smaller than the inside diameter of the neck 5 so as not to touch the glass neck. Since the electron-beam through holes are generally mode as large as possible to provide for the aperture of the electronic lens, the outside diameters of the bathtub-shaped electrodes are large, making the gap g' between the insulating supports and the side walls of the electrodes significantly narrower. This is illustrated in FIG. 6, which is a cross-sectional view taken along the line VI—VI in FIG. 5B.

With the above-described electrode structure, for example, a cutoff voltage of 200 V and a video signal are applied to the cathodes, a ground potential is applied to the grid G1, a voltage of 500 V to 1 KV is applied to the grid G2, a voltage of 5 KV to 10 KV is applied to the grid G3, and a high anode voltage of 25 KV is applied to the grid G4. The high anode voltage is applied to the grid G4 via the conductive film 10, the spring BS, and the convergence cup CP, while the other electrode potentials are applied via a stem pin STP at the lower end of the neck 5. The application of such potentials forms high-performance electronic lenses as described in Jpn. Pat. Appln. KOKAI Publication No. 1-236554.

However, the color CRT using this technique has a poor withstand voltage characteristic, which is critical to the color CRT. This shortcoming is due to the electric field discharged from an edge 29 of the eaves-shaped electric-field compensating electrode 28-1 inserted inside the bathtub-shaped electrode 27-2. Normally, a high voltage is applied between the electrodes to execute the voltage withstanding process to process projecting objects and eliminate dust particles during the manufacturing of a color CRT. As the edge 29 is located inside the bathtub-shaped electrode 27, the process can hardly be executed. The same is of course true of the grid-G4 side, and the compensating electrode 28-2 also causes the problem of a poor withstand voltage characteristic.

Further, in a color CRT having a resistor disposed in the proximity of the electron gun in the neck, the resistor interferes with the voltage withstanding process on the electrodes in the vicinity of the resistor, including that electrode to which a potential is applied by the resistor. This is because the electric discharge can be suppressed by the resistor, even when a high voltage is applied during the process. Accordingly, the projecting objects and dust particles remain, particularly between the electrodes and the insulating supports of the electrodes, so that minute discharge occurs in the vicinity of the electrodes during the normal function of the color CRT, thus causing adverse effects, such as altering the focusing of electron beams. When the electrode structure having the eaves-shaped electric-field compensating electrode 28 inserted inside the bathtub-shaped electrode 27 is used in such a color CRT, the withstand voltage characteristic is further impaired.

To produce good image characteristics over the entire screen of a color CRT, as described above, it is effective to use an electron gun which is designed to form asymmetric electronic lenses in front of and at the back of a normal symmetric cylindrical electronic lens within the lens region or have a resistor provided in the vicinity of the electron gun to supply the proper electrode potential. According to the prior art, however, the withstand voltage characteristic, which is critical to the color CRT, is poor.

SUMMARY OF THE INVENTION

It is therefore an object of the present invention to provide a color CRT having a simple electrode structure and a good withstand voltage characteristic while maintaining an excellent electronic lens characteristic.

The color CRT of the present invention comprises at least an electron gun assembly, a deflecting section, a screen section, and a vacuum envelope for enclosing them. The electron beams launched from the electron gun assembly are deflected in the vertical and horizontal directions by the deflecting section. The electron gun assembly has at least an electron-beam generating section including cathodes, and a main electronic lens section for focusing a plurality of in-line electron beams on the screen section. The main electronic lens section includes a plurality of grids, each having electron-beam through holes and securely supported by a plurality of insulating supports, and at least one of the grids having a portion with a substantially rectangular cross section for commonly enclosing the plurality of in-line electron beams and a face having electron-beam through holes formed at least at one end and substantially perpendicular to the portion. The substantially rectangular portion has an outside long side length $L_H$ in a long-axial direction and an outside short side length $L_S$ in a short-axial direction such that the ratio of the outside length $L_H$ to the outside length $L_S$, $L_H/L_S$, is $$2.5<L_H/L_S<4.4$$

and the ratio of the outside diameter $L_S$ in the short-axial direction to a diameter $D_V$ of the electron-beam through holes in the same short-axial direction, $L_S/D_V$, is $$1.0<L_S/D_V<2.1.$$

Since the color CRT of this invention has a flat electrode structure in which the outside diameters of the electrodes in the short-axial direction are smaller than those of the electrodes in the long-axial direction, the inside diameters of the electrodes are smaller accordingly. This structure can form asymmetric electronic lenses in front of and at the back of a symmetric cylindrical electronic lens within the lens region. It is, therefore, possible to improve the performance of the electronic lenses.

As the eaves-shaped electric-field compensating electrode which is used in the prior art becomes unnecessary, no electric-field emission from the edge of the eaves-shaped electric-field compensating electrode occurs, so that the poor withstand voltage characteristic of the prior art which is critical to a color CRT can be improved significantly.

As the electrode structure of the color CRT of this invention can secure a sufficient distance between the electrode supports and the electrodes, the voltage withstanding process between the electrode supports and the electrodes becomes better in eliminating dust particles and processing projecting objects from therebetween. The withstand voltage characteristic of the color CRT is thus further improved. This action becomes more prominent in a color CRT which is designed to have a resistor provided in the vicinity of the electron gun to supply the proper electrode potential.

The elimination of the need for the eaves-shaped electric-field compensating electrode can considerably simplify the structure of the electron gun, facilitating mass-production of electron guns and resulting in great economical advantage. Hence, the present invention can provide a color CRT which is very practical and has a high industrial value.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Color cathode ray tubes according to preferred embodiments of the present invention will now be described referring to the accompanying drawings.

Figure 5A:
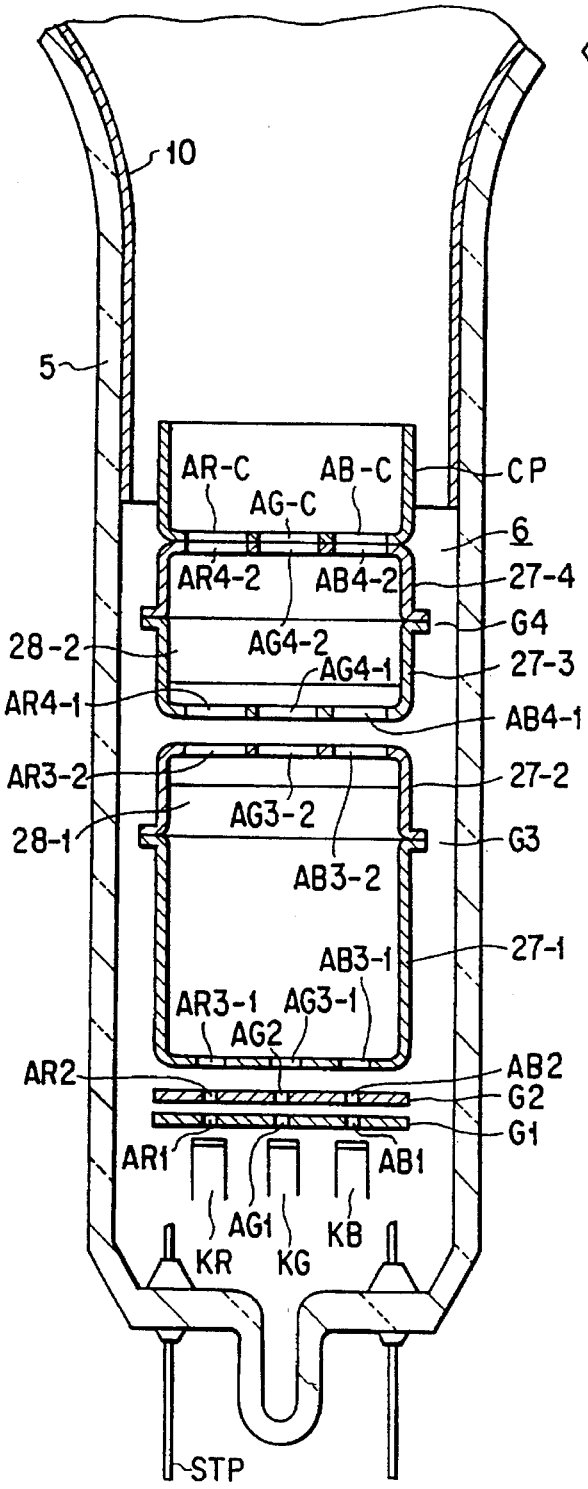
FIG. 5A (PRIOR ART)
FIGS. 5A and 5B are cross-sectional views schematically showing the structure of the electron gun of the conventional color CRT in FIG. 1.
Figure 5B:
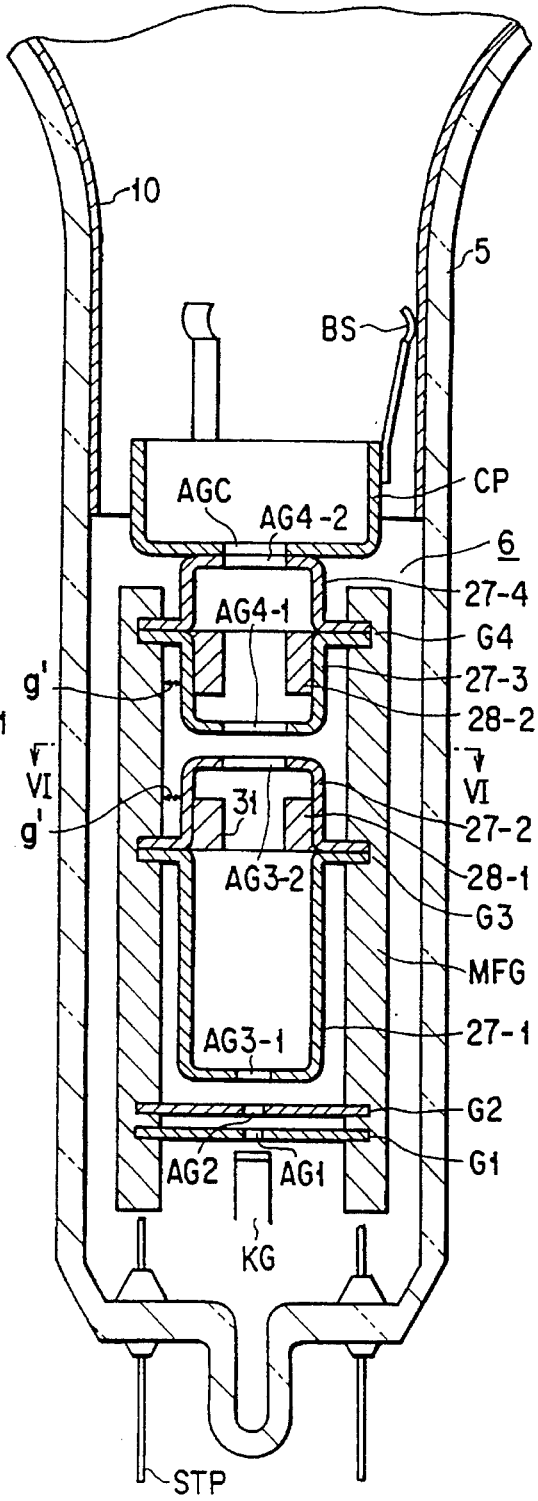
FIG. 5B (PRIOR ART)
Figure 7A:
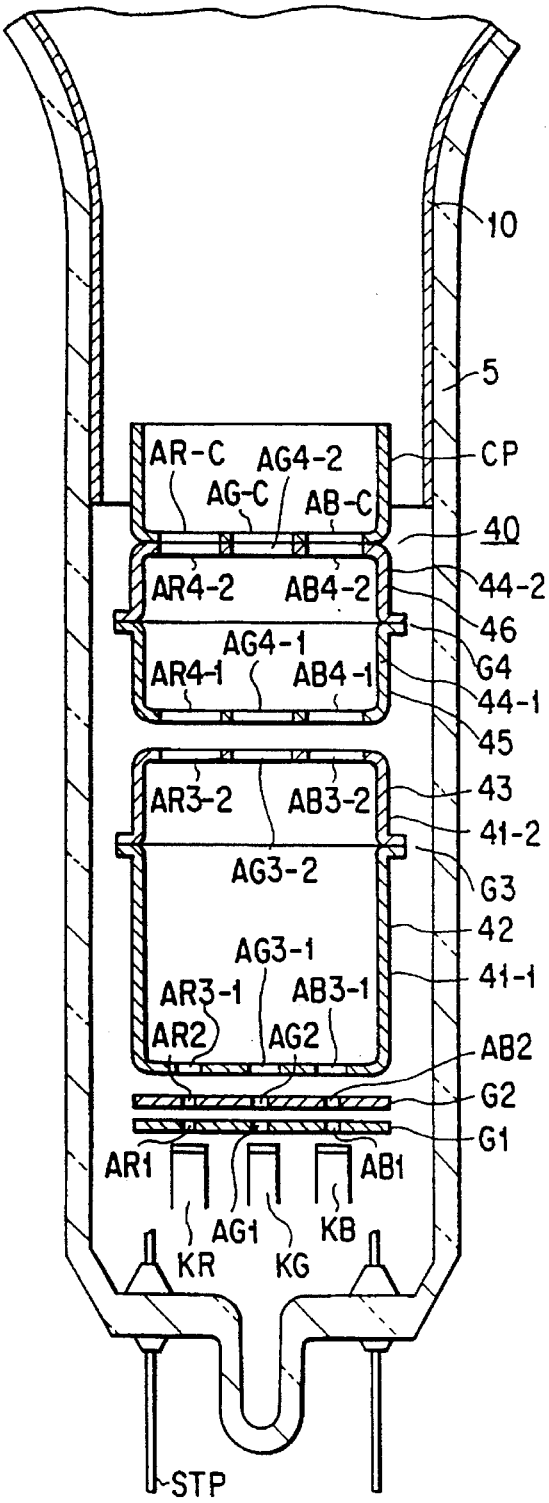
FIGS. 7A and 7B are cross-sectional views schematically showing the structure of an electron gun of a color CRT apparatus according to one embodiment of the present invention.
Figure 7B:
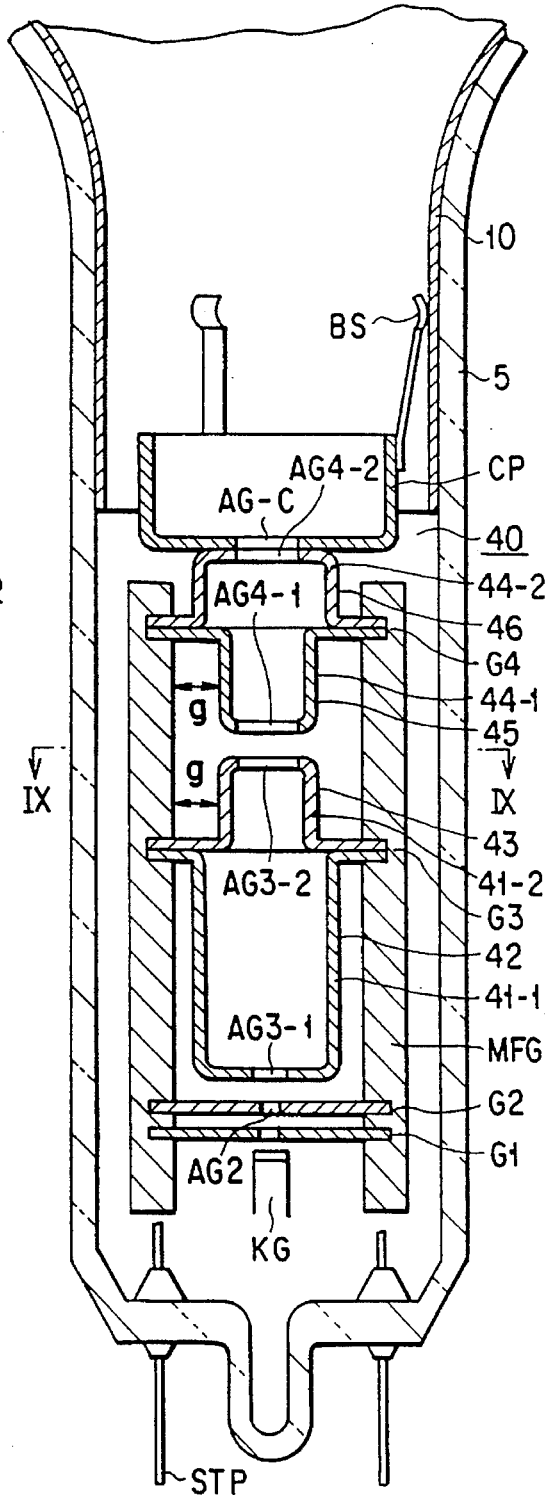

FIGS. 7A and 7B are cross-sectional views of the main portion of a color CRT embodying this invention. Like or same reference numerals as used in FIGS. 5A and 5B are given in FIGS. 7A and 7B to denote corresponding or identical components. In FIGS. 7A and 7B, an electron gun 40 is disposed in a neck 5. The electron gun 40 has three cathodes KR, KG, and KB, each housing a heater (not shown), and arranged in a straight line, a first grid G1, a second grid G2, a third grid G3, a fourth grid G4, and a convergence cup CP. These components are arranged in the named order along the tube axis, and are securely supported by insulating supports MFG.

The grids G1 and G2 are thin plate-shaped electrodes of 0.2-mm in thickness. The grid G1 has three small electron-beam through holes AR1, AG1, and AB1 of about 0.7 mm in diameter bored through it at center distances of 6.6 mm. The grid G2, likewise, has three small electron-beam through holes AR2, AG2, and AB2 of about 0.7 mm in diameter bored through it at center distances of 6.6 mm.

The grid G3 comprises two bathtub-shaped electrodes 41-1 and 41-2. The bathtub-shaped electrode 41-1 has three electron-beam through holes AR3-1, AG3-1, and AB3-1, 1.3 mm in diameter, bored through it in the G2-side portion. This bathtub-shaped electrode 41-1 has a cylindrical portion 42 having an outside length of 21.3 mm in the long-axial direction and an outside length of 9.5 mm in the short-axial direction.

The grid-G4 side bathtub-shaped electrode 41-2 has a rectangular cup portion 43 having an outside length of 21.3 mm in the long-axial direction, like the G2-side electrode, and an outside length of 7.8 mm in the short-axial direction, considerably smaller than that of the G2-side electrode. The bathtub-shaped electrode 41-2 has three electron-beam through holes AR3-2, AG3-2, and AB3-2, 6.2 mm in diameter, bored through that side which faces the grid G4 at spacings of 6.6 mm, measured between the centers of two adjacent holes.

Figure 1:
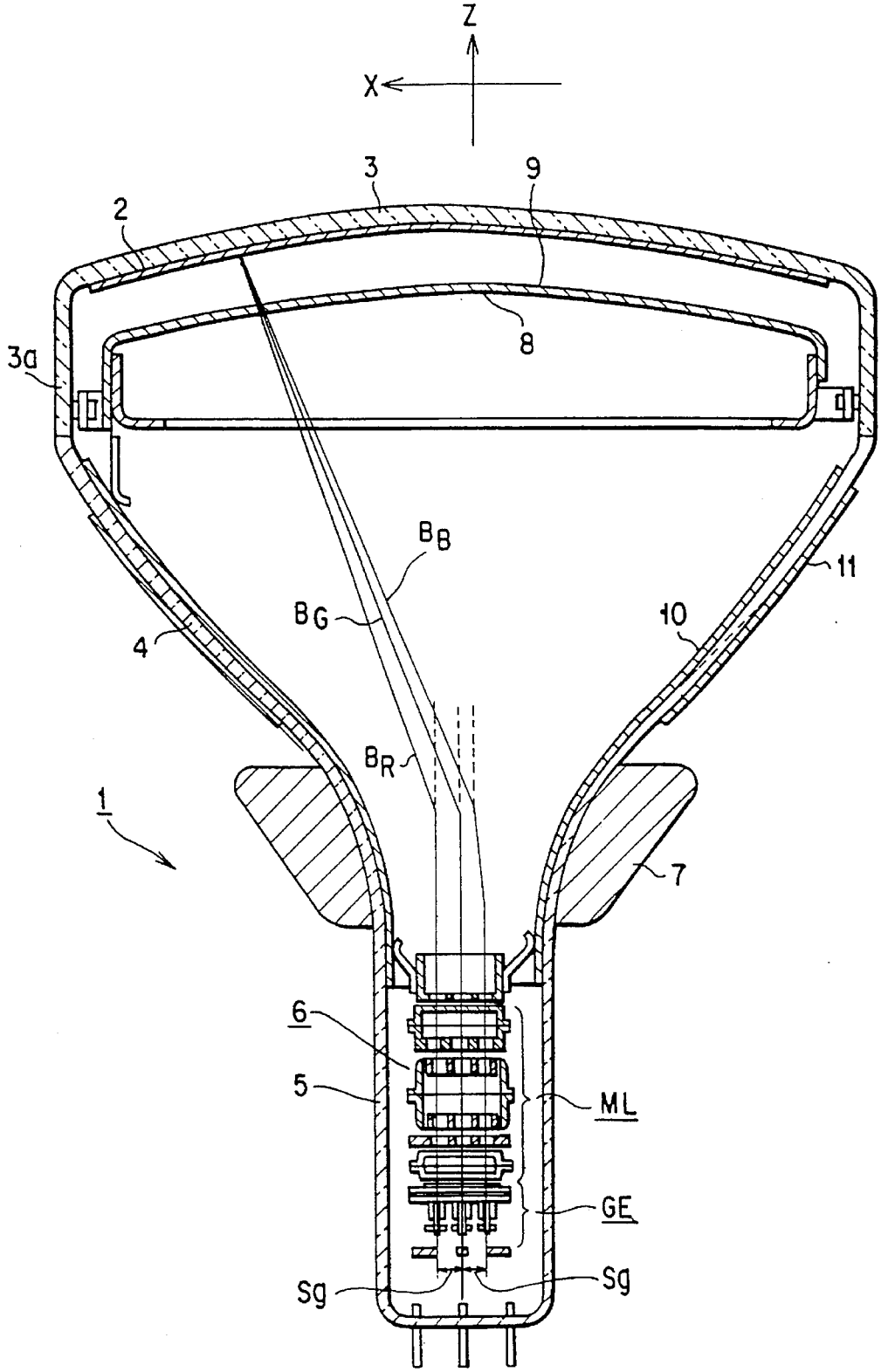
F I G. 1 (PRIOR ART)
FIG. 1 is a cross-sectional view schematically showing the internal structure of a conventional color CRT apparatus.
Figure 2A:
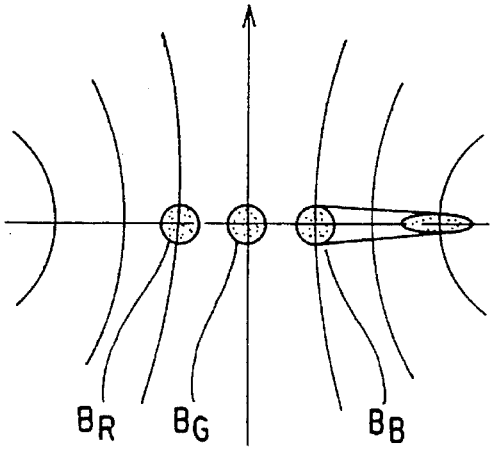
FIG. 2A (PRIOR ART)
FIGS. 2A and 2B are plan views for explaining the deformation of electron beams which is caused by the horizontal and vertical deflection magnetisms in the color CRT apparatus shown in FIG. 1.
Figure 2B:
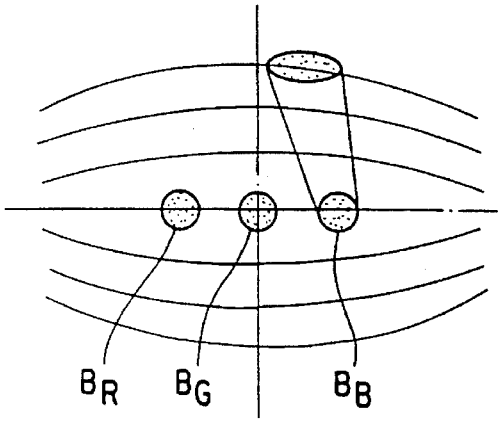
FIG. 2B (PRIOR ART)
Figure 3:
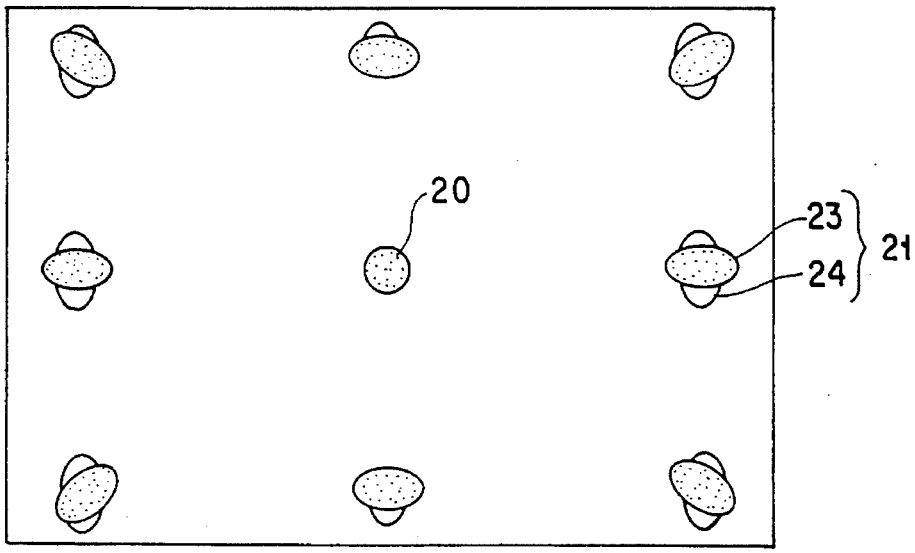
FIG. 3 (PRIOR ART)
FIG. 3 is a plan view showing the shapes of beam spots on a screen.
Figure 4:
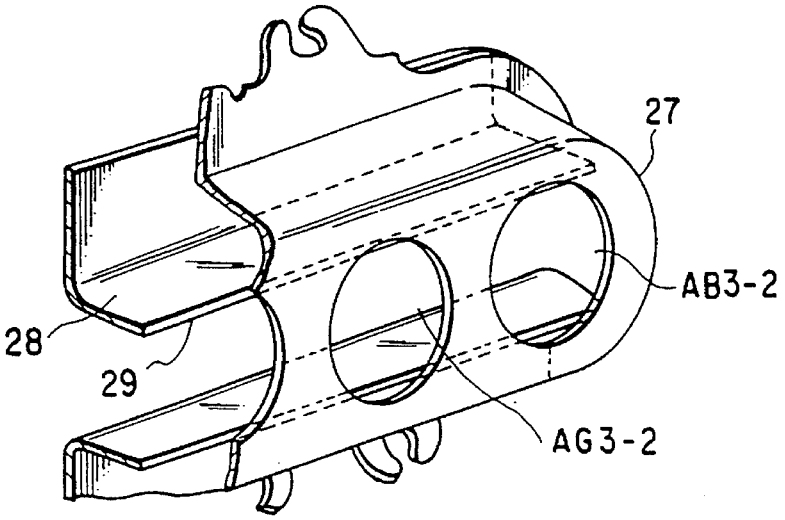
FIG. 4 (PRIOR ART)
FIG. 4 is a perspective view schematically showing the electrode structure of an electron gun of the conventional color CRT in FIG. 1.
Figure 6:
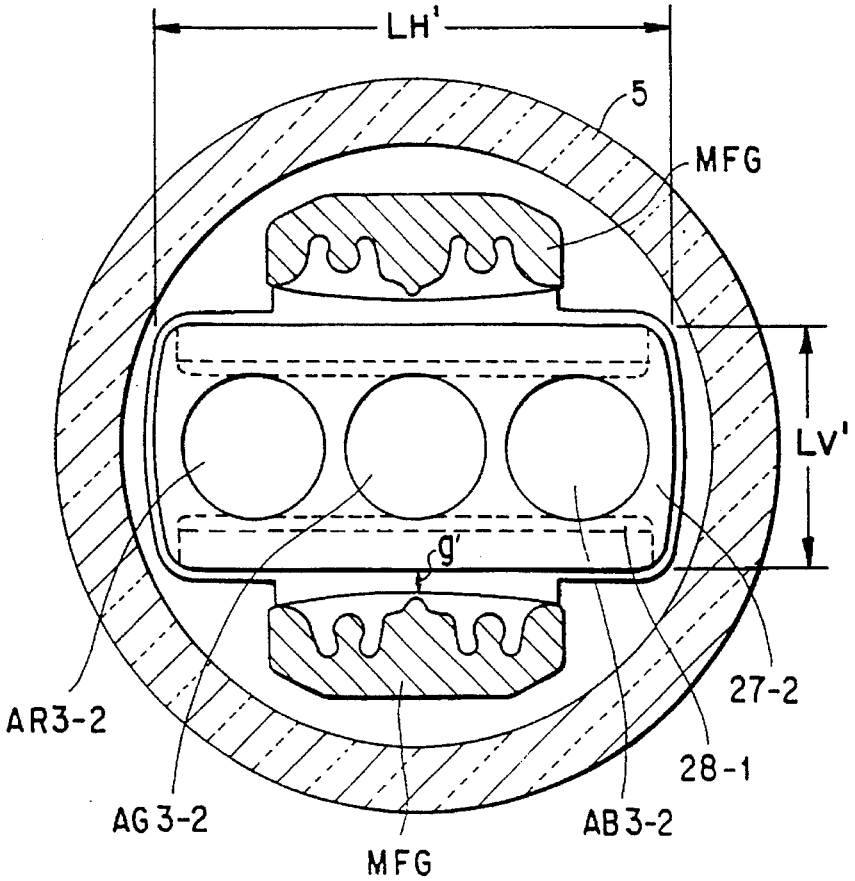
FIG. 6 (PRIOR ART)
FIG. 6 is a cross-sectional view of the electron gun taken along the line VI—VI and as viewed in the direction of the arrows in FIG. 5B.
Figure 8:
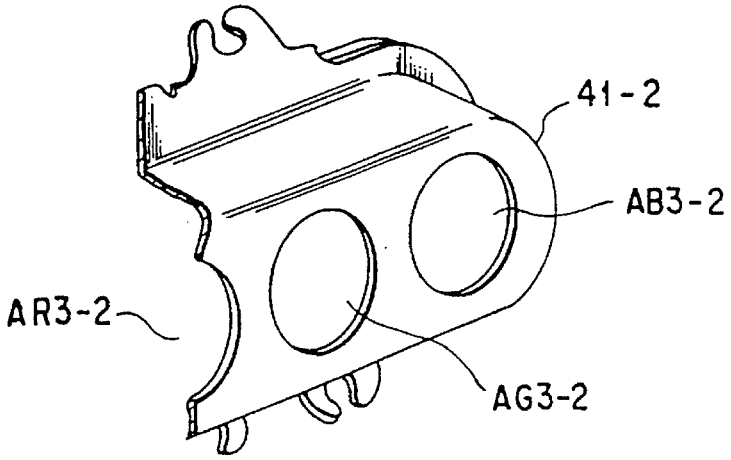
FIG. 8 is a perspective view schematically showing the electrode structure of the electron gun shown in FIGS. 7A and 7B.
Figure 9:
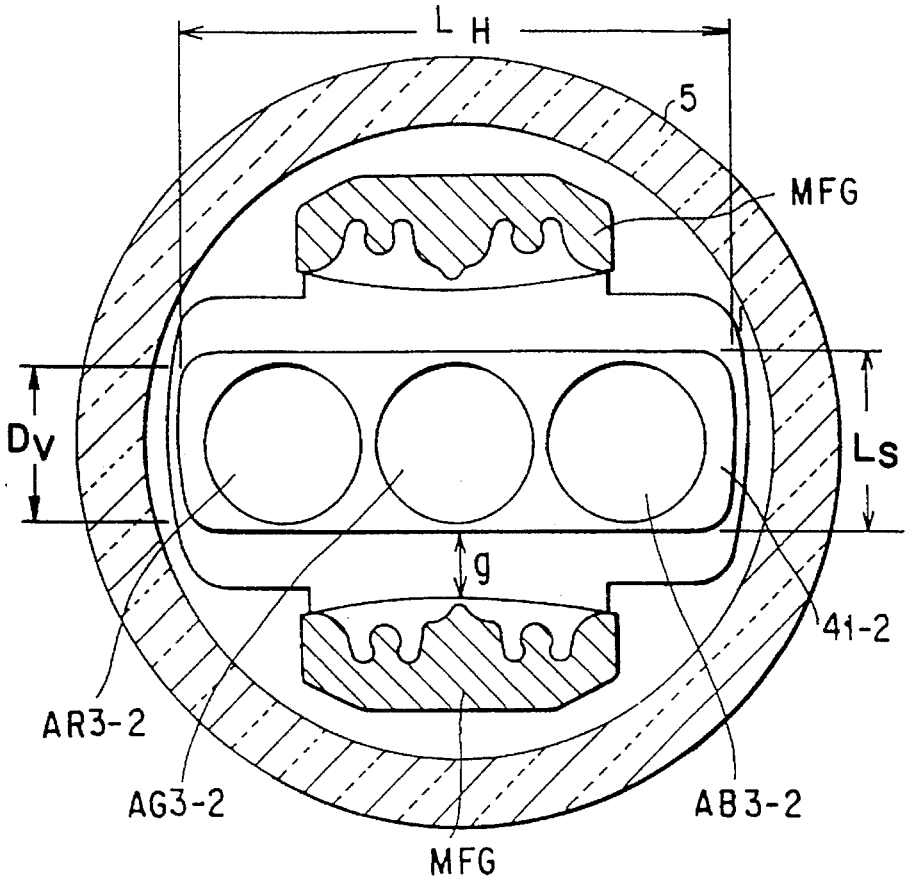
FIG. 9 is a cross-sectional view of the electron gun taken along the line IX—IX and as viewed in the direction of the arrows in FIG. 7B.

In other words, while the ratio of the outside length $L_H$ in the long-axial direction of the rectangular cup portion 42 of the G2 side bathtub-shaped electrode 41-1 to the outside length $L_S$ in the short-axial direction, $L_H/L_S$, like those of the conventional bathtub-shaped electrodes 27-1 and 27-2, is 2.24, the rectangular cup portion 43 of the G4 side bathtub-shaped electrode 41-2 is considerably longer than those of the conventional bathtub-shaped electrodes 27-1 and 27-2, and the ratio and $L_H/L_S$ is 2.73. The perspective view of this electrode 41-2 is illustrated in FIG. 8 as a comparison with FIG. 4. FIG. 9 shows a cross section taken along the line IV—IV in FIG. 7B. It is apparent from FIG. 9 as compared with FIG. 6 that the gap g' between the electrode 41-2 and the insulating support is sufficiently larger.

The grid G4, like the grid G3, comprises two bathtub-shaped electrodes 44-1 and 44-2. The bathtub-shaped electrode 44-1, like the G4 side bathtub-shaped electrode 41-2 of the grid G3, has three electron-beam through holes AR4-1, AG4-1, and AB4-1, 6.2 mm in diameter, bored through in the G3 side portion. This bathtub-shaped electrode 44-1 has a rectangular cup portion 45, which has a long side length of 21.3 mm in the long-axial direction and a short side length of 7.8 mm in the short-axial direction, and is thus considerably long. The spacing between the three through holes AR4-1, AG4-1, and AB4-1 is about 6.8 mm, wider than that of the through holes AR3-2, AG3-2, and AB3-2, whereby three electron beams are converged on the screen.

The bathtub-shaped electrode 44-2, located on the side of the convergence cup CP, has a rectangular cup portion 46, which is similar to that of the G2-side bathtub-shaped electrode 41-1 of the grid G3, and is 21.3 mm in outside length in the long-axial direction and 9.5 mm in outside length in the short-axial direction. The electrode 44-2 has three electron-beam through holes AR4-2, AG4-2, and AB4-2, 6.2 mm in diameter, bored through in the one end face at spacings of 6.6 mm.

The cylindrical convergence cup CP is welded to the screen side of the grid G4. The convergence cup CP comprises a single large cylinder, which is open on the screen side, and has three electron-beam through holes AR-C, AG-C, and AB-C, 4.5 mm in diameter, formed in the G4 side in association with the grids G3 and G4. Attached to this convergence cup CP is a spring BS as per the prior art.

Since, as shown in FIG. 9 the outside lengths $L_V$ of the bathtub-shaped electrodes 41-2 and 44-1 facing the grids G3 and G4 in the short-axial direction are smaller in the electron gun having the above-described structure, as is apparent from the diagrams, the gap g between the insulating supports and the electrodes becomes significantly wider, thus considerably improving the withstand voltage characteristic. It is, therefore, very desirable from the viewpoint of the withstand voltage characteristic that the electrode to which a high anode voltage is applied and the electrode facing the former one have the above-described structure.

During the operation of a color CRT apparatus, including the ON/OFF switching, the intensity of an electric field between the electrode to which a high anode voltage is applied and the electrode facing the former one reaches 25 KV/mm to 30 KV/mm, so that a concentration of the electric field easily occurs due to any slight projection, dust particles or the like, causing an electric discharge. Consequently, a high voltage is applied to the aforementioned electrodes during the manufacturing of the color CPT to perform a voltage withstanding process to deal with the projections and dust particles. In the processing of the surfaces of the opposing electrodes, it is difficult to process projecting objects or foreign matter inside the electrodes and on the surfaces of the electrodes and insulating supports. There is also a problem in that dust particles or the like are likely to fall from the shadow mask inside the color CRT, the phosphor screen, the internal conductive film, etc. and stay between the insulating supports and the electrodes.

with respect to this problem, even though the voltage withstanding process is not easily performed on the surfaces of the electrodes and insulating supports in the above-described structure, the intensity of the electric field between the insulating supports and the electrodes rapidly decreases because the gap between the insulating supports and the electrodes is wide, thus making it unlikely for a concentration of the electric field which would have cause an electric discharge. Actually, the process seems to be performed well. It is believed that as a result of the wide gap foreign matter tend to move to the portion which does not cause an electric discharge.

Further, since the gap between the insulating supports and the electrodes is wide in the above-described structure, even if dust particles or the like fall from the shadow mask inside the color CRT, the phosphor screen, the internal conductive film, etc., the dust particles are not likely to stay between the insulating supports and the electrodes, so a higher withstand voltage characteristic can be ensured.

Furthermore, as there is no disadvantageous, eaves-shaped electrode inside the electrodes, the voltage withstanding process only has to be performed on the surfaces of the opposing electrodes, without having to worry about the projecting a objects in the electrodes or dust particles.

Figure 10A:
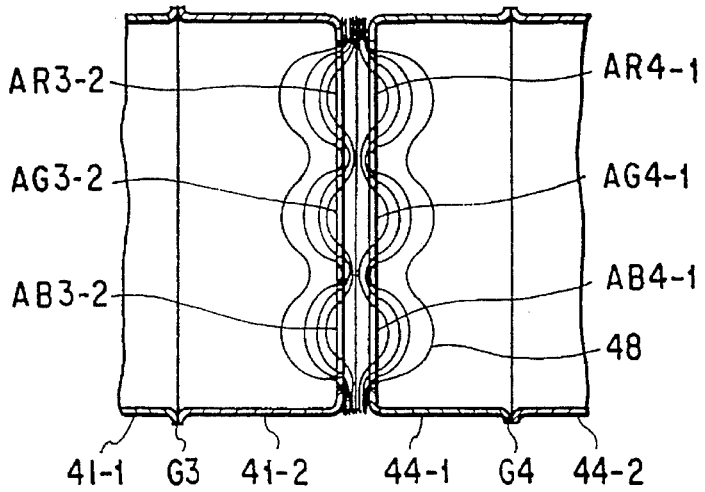
FIGS. 10A and 10B show the distributions of the potentials generated at the essential portions of the electron gun.
Figure 10B:
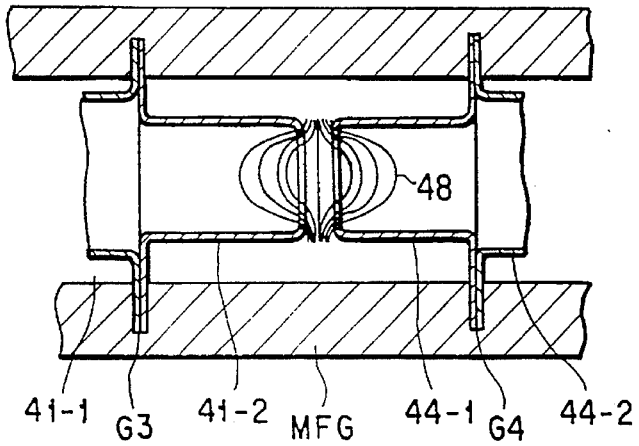
Figure 11A:
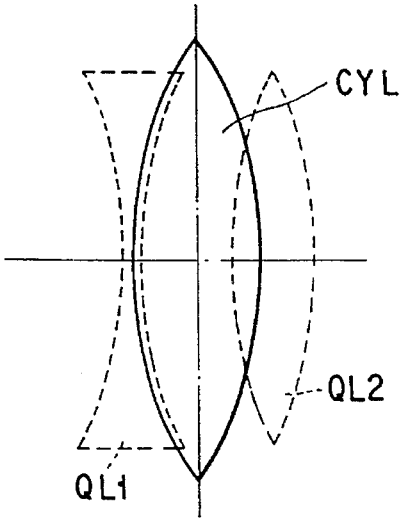
FIGS. 11A and 11B are schematic diagrams showing electronic lenses which are respectively formed by the potential distributions shown in FIGS. 10A and 10B.
Figure 11B:
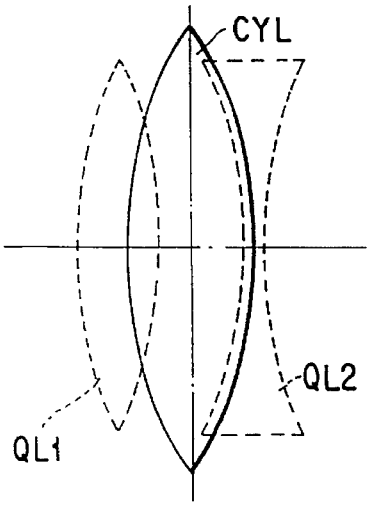

With the above-described electrode structure, for example as in the prior art, a cutoff voltage of 200 V and a video signal are applied to the cathodes, a ground potential is applied to the grid G1, a voltage of 500 V to 1 KV is applied to the grid G2, a voltage of 5 KV to 10 KV is applied to the grid G3, and a high anode voltage of 25 KV is applied to the grid G4. The application of such potentials provides an equipotential line 48 of the grids G3 and G4 as shown in FIGS. 10A and 10B. More specifically, the horizontal potential distribution becomes gentle as shown in FIG. 10A, while the vertical potential distribution is strong with sharp curvatures as shown in FIG. 10B because the ratio of the outside length of the bathtub-shaped electrode in the short-axial direction to the vertical diameter $D_V$ of the beam through holes is smaller than that of the prior art. That is, $L_S/D_V$ is 7.8 mm/6.2 mm=1.26, smaller in value than the same ratio of the prior art, which is 9.5 mm/6.2 mm=1.53. It is, therefore, considered that the following electronic lenses are formed according to such potential distributions. In the horizontal direction, a large focusing lens CYL by the cylinder lens, a quadrupole lens QL1, which has a divergent action toward the grid G3, and a quadrupole lens QL2, which has a focusing action toward the grid G4, are formed as shown in FIG. 11A. In the vertical direction, a large focusing lens CYL by the cylinder lens, a quadrupole lens QL1, which has a convergent action toward the grid G3, and a quadrupole lens QL2, which has a divergent action toward the grid G4, are formed as shown in FIG. 11B. Accordingly, the electronic lens system has an excellent characteristic as disclosed in Jpn. Pat. Appln. KOKAI Publication No. 1-236554. To simplify the description, FIGS. 11A and 11B give only the illustration about the center beam through hole with respect to the horizontal direction.

As described above, a color CRT apparatus embodying this invention can ensure high resolution by the high-performance electronic lenses and has an excellent withstand voltage characteristic. If a discharge occurs during the operation of the color CRT apparatus, the loud sound due to the discharge may surprise viewers, the color CRT may suddenly stop supplying information to the viewers momentarily, or the discharge may cause a large current of several hundred amps, occasionally, over a thousand amps, to flow through the color CRT, completely destroying the circuitry critical to the functioning of the color CRT. The present invention can overcome these problems.

Although a bathtub-shaped electrode which is very short in the short-axial direction is used for those electrodes of the grids G3 and G4 which face each other in the above-described embodiment, this invention is not limited to this design in that the bathtub-shaped electrode may be used just for the grid G4. Further, the ratio of the horizontal outside length of the rectangular cup portion of the grid G3 to that of the grid G4 may be changed. This scheme of changing the ratio of the horizontal outside length of the rectangular cup portion of the grid G3 to that of the grid G4 is important in adjusting the electronic lenses.

If the bathtub-shaped electrode is used only for the grid G4, the withstand voltage characteristic is also considerably improved as compared with that of the prior art. In this case, the lens action would become as described in Jpn. Pat. Appln. KOKOKU Publication No. 60-7345, and the beam spots at the peripheral portion of the screen would have a nice size.

The bathtub-shaped electrode may be used only for the grid G3, or a bathtub-shaped electrode very short in the short-axial direction may also be used for the G2 side electrode of the grid G3. In the latter case, the electrode-supporting strength of the insulating supports is slightly weakened, thus requiring the mechanical strength of the strap portion be increased. It should, however, be noted that the G2 side electrode of the grid G3 does not contribute to the improvement of the withstand voltage characteristic so much, and has beam through holes so small that the asymmetrical lens will not be formed even when the outside of the bathtub-shaped electrode in the short-axial direction is made smaller, thus the improvement in lens performance cannot be expected.

Although this invention is applied to a color CRT having a typical electron gun comprising four grids G1, G2, G3, and G4 in the above-described embodiment, this invention is not limited to this particular type of CRT, but may be applied to a color CRT equipped with an electron gun having a greater number of grids.

Figure 12A:
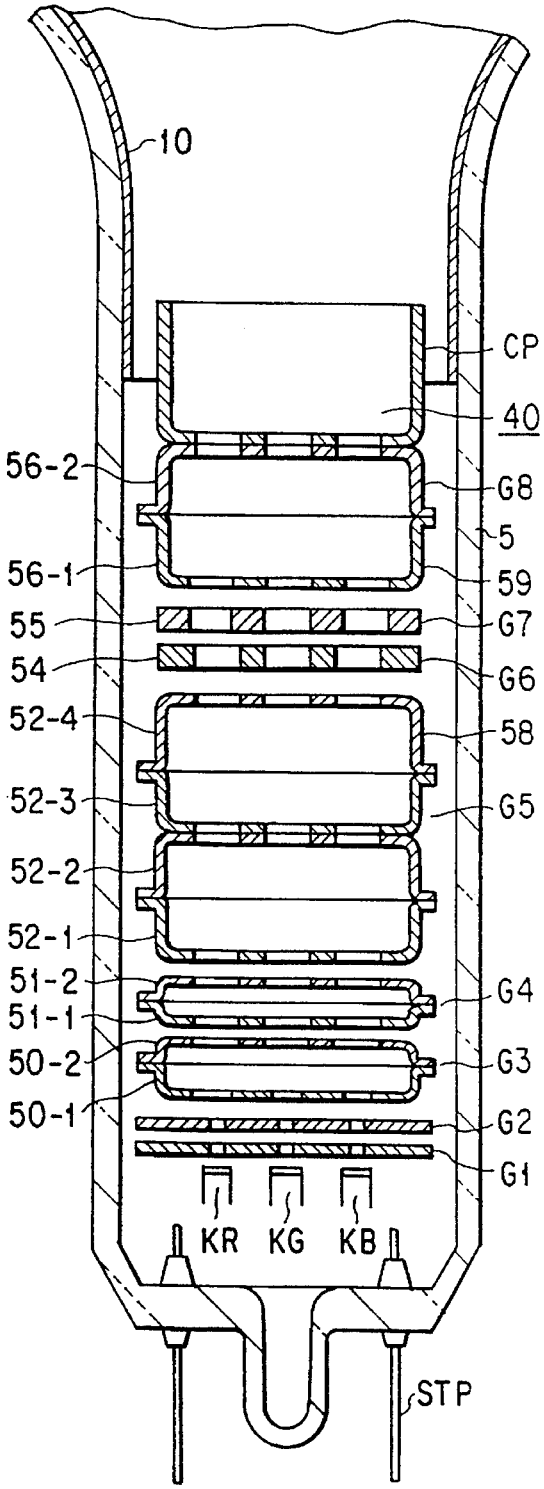
FIGS. 12A and 12B are cross-sectional views schematically showing the structure of an electron gun of a color CRT apparatus according to another embodiment of this invention.
Figure 12B:
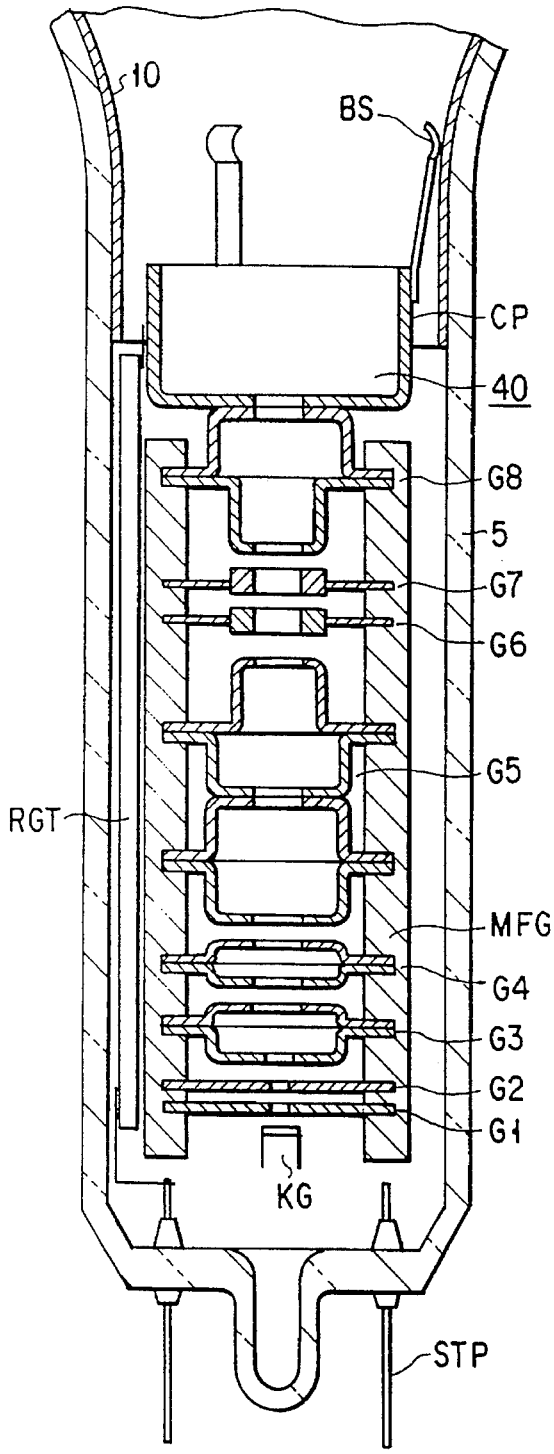

FIGS. 12A and 12B illustrate another embodiment of this invention. Like or same reference numerals as used in FIGS. 7A and 7B are given in FIGS. 12A and 12B to denote corresponding or identical components. In FIGS. 12A and 12B, an electron gun 40 is disposed in a neck 5. The electron gun 40 has three cathodes KR, KG, and KB, each housing a heater (not shown), and arranged on a straight line, a first grid G1, a second grid G2, a third grid G3, a fourth grid G4, a fifth grid G5, a sixth grid G6, a seventh grid G7, an eighth grid G8, and a convergence cup CP. Those components are arranged in the named order along the tube axis, and are securely supported by insulating supports MFG. A resistor RGT is provided at the back of the insulating supports MFG, and has one end connected to the convergence cup CP to which a high anode voltage is applied and the other end grounded or connected to an adjusting potential outside the tube via a stem pin. A proper middle portion of this resistor RGT is coupled with the grids G6 and G7 to supply a divided potential of the high anode voltage to the electrodes of those grids G6 and G7.

The grids G1 and G2, located in front of the three in-line cathodes, are thin plate-shaped electrodes having small electron-beam through holes formed through them. The grid G3 has two shallow bathtub-shaped electrodes 50-1 and 50-2, the grid G4 likewise has two shallow bathtub-shaped electrodes 51-1 and 51-2, and the grid G5 has four deep bathtub-shaped electrodes 52-1, 52-2, 52-3, and 52-4. The grid G6 has a single thick plate-shaped electrode 54 and the grid G7 has a single thick plate-shaped electrode 55. The grid G8 comprises two bathtub-shaped electrodes 56-1 and 56-2, and the convergence cup CP is substantially cylindrical and has a flat portion where part of the resistor RGT is located. Each of the individual electrodes has electron-beam through holes formed therethrough.

With this structure, the bathtub-shaped electrodes which are arranged from the grid G1 to the bathtub-shaped electrode 52-3 in the middle of the grid G5, and the screen-side electrode 56-2 of the grid G8, each has an outside length of 21.3 mm in the long-axial direction and an outside length of 9.5 mm in the short-axial direction as in the prior art. The ratio of the outside length $L_H$ in the long-axial direction to the outside length $L_S$ in the short-axial direction, $L_H/L_S$, is 2.24.

The G6 side bathtub-shaped electrode 52-4 of the grid G5 has a cylindrical portion 58 having an outside length of 21.3 mm in the long-axial direction, and an outside length of 7.8 mm in the short-axial direction, considerably smaller than those of the previously mentioned electrodes. The grid G5 have three electron-beam through hole, 6.2 mm in diameter, bored at a spacing of 6.6 mm. The electrode 52-4 is horizontally long, and the ratio of the outside length $L_H$ in the long-axial direction to the outside length $L_S$ in the short-axial direction, $L_H/L_S$, is 2.73. The ratio of the outside diameter $L_S$ to the vertical length $D_V$ of the beam through holes, $L_S/D_V$, is 1.26, which is smaller than the one mentioned previously.

The grids G6 and G7 are thick electrodes of 2.0 mm in thickness, each having three electron-beam through holes, 6.2 mm in diameter, bored therethrough at spacings of 6.6 mm to 6.8 mm (to converge the three electron beams on the screen). Those thick electrodes are larger and longer than the conventional electrodes, and have an outside diameter of 22.0 mm in the long-axial direction and an outside length of 8.0 mm in the short-axial direction. The ratio of the outside length $L_H$ in the long-axial direction to the outside length $L_S$ in the short-axial direction, $L_H/L_S$, is 2.75.

Further, the G7 side bathtub-shaped electrode 56-1 of the grid G8 is longer than the conventional electrodes, and has a rectangular cup portion 59 having an outside length of 22.0 mm in the long-axial direction and an outside length of 7.8 mm in the short-axial direction. The ratio of the outside length $L_H$ in the long-axial direction to the outside length $L_S$ in the short-axial direction, $L_H/L_S$, is therefore 2.82. Three electron-beam through holes, 6.2 mm in diameter, are bored through the G7 side end of the electrode 56-1 at spacings of 6.8 mm. Thus, the ratio of the outside length $L_S$ to the vertical diameter $D_V$ of the beam through holes, $L_S/D_V$, for this electrode 56-1 is 1.26, smaller than that of the prior art.

With the above-described electrode structure, for example as in the prior art, a cutoff voltage of 200 V and a video signal are applied to the cathodes, a ground potential is applied to the grid G1, a voltage of 500 V to 1 KV is applied to the grids G2 and G4, a voltage of 5 KV to 10 KV is applied to the grids G3 and G5, a voltage of 8 KV to 15 KV is applied to the grid G6, a voltage of 17 KV to 24 KV is applied to the grid G7, and a high anode voltage of 25 KV to 30 KV is applied to the grid G8. The application of such potentials forms high-performance electronic lenses as described in Jpn. Pat. Appln. KOKAI Publication No. 64-38947 for the following reason. As described with reference to the previous embodiment, the horizontal penetration of the potential is easy for the G6 side of the grid G5 and the G7 side of the grid G8, whereas the vertical penetration of the potential is suppressed because the ratio of the outside length of the rectangular cup portion in the short-axial direction to the vertical diameter $D_V$ of the beam through holes is smaller than that of the prior art. Accordingly, a weak quadrupole lens having a divergent action in the horizontal direction and a focusing action in the vertical direction is formed on the G6 side of the grid G5, a weak quadrupole lens having a convergent action in the horizontal direction and a divergent action in the vertical direction is formed on the G7 side of the grid G8. As each of the grids G6 and G7 comprises a single thick electrode, a smooth cylindrical electronic lens is formed in the area from the grid G5 to the grid G8. While the high-performance electronic lens system is formed in this manner, the color CRT of this embodiment, like that of the previous embodiment, exhibits an excellent withstand voltage characteristic as compared with the prior art.

Since longer bathtub-shaped electrodes are used near those opposing electrodes to which a high anode voltage is applied, the gap between the insulating supports and the electrodes near that place is wide enough that a strong electric field to initiate a discharge at that portion will not be generated. Further, it is unlikely that dust particles or the like would fall from the shadow mask inside the color CRT, the phosphor screen, the internal conductive film, etc., and stay in the clearance between the insulating supports and the electrodes near the opposing electrodes to which a high anode voltage is applied.

Furthermore, as there is no disadvantageous, eaves-shaped electrode inside the electrodes, the voltage withstanding process has only to be performed on the surfaces of the opposing electrodes, without having to worry about the projecting objects in the electrodes or dust particles.

It is, therefore, possible to provide a high-performance electronic lens system while allowing the electronic lens to have an asymmetry, and significantly improve the withstand voltage characteristic which is very important to a color CRT.

The ratio of the horizontal outside diameter of the thick electrode of the grid G6 to that of the grid G7 is made smaller than the ratio of the horizontal outside length of the bathtub-shaped electrode of the grid G5 to that of the grid G8 in this embodiment. This is because each of the grids G6 and G7 is a single thick electrode so that if the horizontal length ratio is set too large, the support piece to the insulating supports becomes long, thus weakening the support strength. But, this invention is not limited to this particular design. The horizontal length ratio may be increased if the supporting means is reinforced. Even if the electrodes having the same outside lengths as the conventional electrodes are used for the grids G6 and G7, the improvement on the withstand voltage characteristic can be expected as parts having a larger horizontal length ratio are used on the G6 side of the grid G5 and the G7 side of the grid G8. Furthermore, shallow bathtub-shaped electrodes with a large horizontal diameter ratio may be used for the grids G6 and G7.

Although the ratio of the horizontal outside length of the rectangular cup portion of the bathtub-shaped electrode to the vertical outside diameter, $L_H/L_S$, is set to 2.75, and three electron-beam through holes are bored through the end face of this bathtub-shaped electrode in the above-described embodiment, this invention is not limited to this design. For instance, this invention may be modified as follows. Although the following will basically describe some modifications of the first embodiment, the same can be applied to the second embodiment because the second embodiment is accomplished by inserting the thick intermediate electrodes in the first embodiment.

Although the high-performance electronic lens at the grids G3 and G4 has weak asymmetrical lenses formed at both ends of the cylindrical lens in the first embodiment, the strength of the asymmetrical lenses is a design matter. Also, although the electron-beam through holes are circular and the outside diameter of the rectangular cup portion of the bathtub-shaped electrode in the short-axial direction is made smaller to form the asymmetrical lenses in the first embodiment, the strength of the lens action can be changed by changing the outside length of the rectangular cup portion in the short-axial direction.

The conventional outside length of the rectangular cup portion of 9.5 mm in the short-axial direction with respect to the vertical diameter of 6.2 mm of the electron-beam through holes does not have a strong influence on the lens to accomplish the high-performance electronic lens. If that outside diameter is made as small as 8.5 mm, the influence on the lens becomes apparent so that the performance of the electronic lens can be improved and the withstand voltage characteristic begins to improved. Although it is desirable that the outside length in the long-axial direction be increased as much as possible, this outside length is determined by the inside diameter of the neck and conventionally ranges from 21.3 mm to 22.0 mm. Therefore, the preferable ratio of the vertical outside length of the rectangular cup portion of the bathtub-shaped electrode to the horizontal outside length, $L_H/L_S$, is 2.5 or greater.

Figure 13:
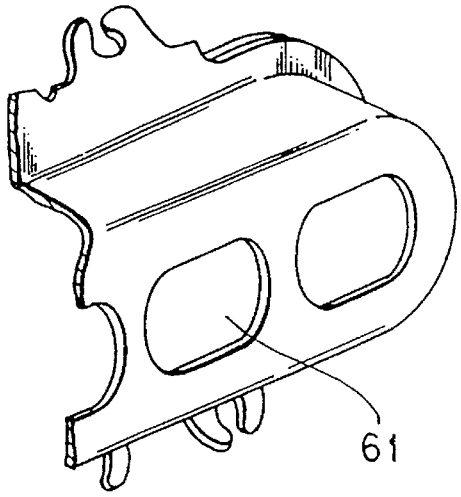
FIG. 13 is a perspective view schematically showing the electrode structure of a color CRT apparatus according to the embodiment depicted in FIGS. 12A and 12B.

To increase the action of the asymmetrical lens, the outside length of the rectangular cup portion in the short-axial direction has only to be made small enough relative to the diameter of the electron-beam through holes. Thus, the outside length of the rectangular cup portion in the short-axial direction can be made as small as 6.2 mm. At this time, the ratio of the outside length of the rectangular cup portion in the short-axial direction to the vertical diameter of the beam through holes, $L_S/D_V$, becomes 1.0. To further increase the action of the asymmetrical lens, as shown in FIG. 13, the beam through holes 61 should be formed in an elliptical shape or an elongated rectangular shape to the size at which the electron beams will not hit each other. Since the diameter of the beam through holes can be generally made as small as about 4 mm, the outside diameter of the rectangular cup portion in the short-axial direction can be made as small as about 5.0 mm. Thus, the ratio $L_H/L_S$ for the rectangular cup portion of the bathtub-shaped electrode can be increased to 4.4.

As described above, it is desirable that the ratio $L_H/L_S$ for the rectangular cup portion of the bathtub-shaped electrode be $$2.5<L_H/L_S<4.4.$$

Figure 14:
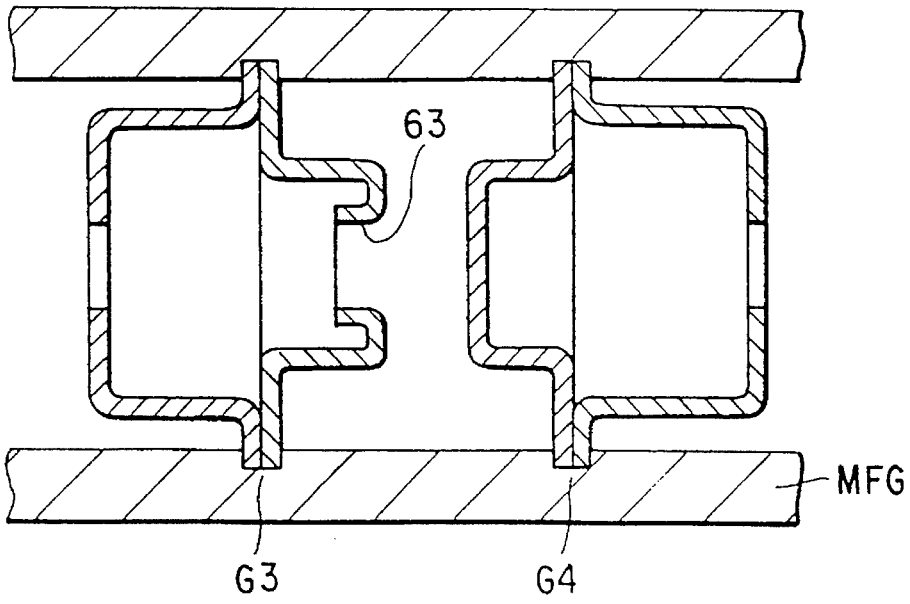
FIG. 14 is a cross-sectional view schematically showing the same electrode structure of a color CRT apparatus of FIG. 13.

To further increase the withstand voltage characteristic, a curl 63 may be provided at the beam through holes as shown in FIG. 14. The length of the curl portion and the strength of the asymmetric lens formed by the outside length of the rectangular cup portion in the short-axial direction can be varied to adjust the lens. If the curl portion is designed sufficiently long, the asymmetrical lens is not formed and only the cylindrical symmetrical lens remains. In this case, while the improvement on the lens performance cannot be expected, a sufficient improvement on the withstand voltage characteristic can be expected.

In short, a color CRT embodiment of this invention can ensure high resolution by the high-performance electronic lens and has an excellent withstand voltage characteristic. Since this invention employs a flat electrode structure wherein the outside length of the electrode in the short-axial direction is smaller than that in the long-axial direction, the inside length in the short-axial direction becomes smaller accordingly, thus allowing asymmetrical electronic lenses to be formed in front of and at the back of the symmetrical cylindrical electronic lens within the lens area. It is, therefore, possible to improve the performance of the electronic lens. Further, as the eaves-shaped electric-field compensating electrode which has been used conventionally becomes unnecessary, no electric-field discharge from the edge of the eaves-shaped electric-field compensating electrode occurs, so that the problem of the prior art in withstand voltage characteristic, which is critical to a color CRT, can be overcome.

Furthermore, since the electrode structure of the color CRT apparatus of this invention can ensure a sufficient distance between the insulating supports and the electrodes, the common problem of dust particles or the like falling from the shadow mask inside the color CRT, the phosphor screen, the internal conductive film, etc. and depositing between the insulating supports and the electrodes will be overcome. The withstand voltage characteristic of the color CRT thus is thus further improved.

The elimination of the need for the eaves-shaped electric-field compensating electrode can considerably simplify the structure of the electron gun, making it possible for very large mass-production of electron guns, thereby graining great economical advantage. With these advantages, the present invention can provide a color CRT which is very practical and has a high industrial value.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A color cathode ray tube comprising:

an electron gun assembly for generating in-line electron beams;

a phosphor screen for emitting light rays when said electron beams land thereon;

a vacuum envelope having a face where said phosphor screen is formed and which accommodates said electron gun assembly;

deflecting means for deflecting said electron beams in vertical and horizontal directions in said vacuum envelope;

said electron gun assembly having an electron-beam generating section, for generating a plurality of in-line electron beams, and a main electronic lens section for converging said plurality of in-line electron beams, generated by said electron-beam generating section, on said phosphor screen, said main electronic lens section including a plurality of grids each having electron-beam through holes and securely supported by a plurality of insulating supports, at least one of said grids having a portion with a substantially rectangular cross section for commonly enclosing said plurality of in-line electron beams and a face having electron-beam through holes formed at one or more ends and substantially perpendicular to said portion having a substantially rectangular cross section, said substantially rectangular portion having an outside length $L_H$ in a long-axial direction and an outside length $L_S$ in a short-axial direction such that a ratio of said outside length $L_H$ to said outside length $L_S$, $L_H/L_S$, is $$2.5<L_H/L_S<4.4$$

and a ratio of said outside length $L_S$ in said short-axial direction to a length $D_V$ of said electron-beam through holes in the same short-axial direction, $L_S/D_V$, is $$1.0<L_S/D_V<2.1.$$

2. The color cathode ray tube according to claim 1, wherein said electron gun assembly includes:

three cathodes for respectively generating three electron beams;

first, second, third, and fourth grids each having through holes to let pass said three electron beams and arranged along a traveling direction of said electron beams; and a convergence cup having through holes formed at one end to let pass said three electron beams and having a common opening at the other end to let pass said three electron beams;

said insulating supports for supporting said three grids and said convergence cup.

3. The color cathode ray tube according to claim 2, wherein said third and fourth grids each include two bathtub-shaped electrodes having opening portions coupled together and each having a short axis perpendicular to a tube axis, and those of said bathtub-shaped electrodes of one of said third and fourth grids, which face each other, have a smaller outside length in a direction of said short axis than the openings of said bathtub-shaped electrodes of the other grid.

4. The color cathode ray tube according to claim 2, wherein said third and fourth grids each include two bathtub-shaped electrodes having opening portions coupled together and each having a short axis perpendicular to a tube axis, and these of said bathtub-shaped electrodes of said fourth grid, which faces said third grid, have a smaller outside length in a direction of said short axis than the openings of said bathtub-shaped electrodes of said third grid.

5. A color cathode ray tube comprising:

an electron gun assembly for generating in-line electron beams;

a phosphor screen for emitting light rays when said electron beams land thereon;

a vacuum envelope having a face where said phosphor screen is formed and which accommodates said electron gun assembly;

deflecting means for deflecting said electron beams in vertical and horizontal directions in said vacuum envelope;

said electron gun assembly having an electron-beam generating section, including cathodes, for generating a plurality of in-line electron beams, and a main electronic lens section for focusing said plurality of in-line electron beams, generated by said electron-beam generating section, on said phosphor screen, said main electronic lens section including a plurality of grids each having electron-beam through holes, at least one of said grids being a single thick metal plate having a substantially rectangular shape having a plurality of electron-beam through holes to let pass said plurality of in-line electron beams, a ratio of an outside length $L_H$ in a long-axial direction of said metal plate to an outside length $L_S$ in a short-axial direction thereof, $L_H/L_S$, being $$2.5<L_H/L_S<4.4$$

and a ratio of said outside length $L_S$ in said short-axial direction to a diameter $D_V$ of said electron-beam through holes in the same short-axial direction, $L_S/D_V$, being $$1.0<L_S/D_V<2.1.$$

6. The color cathode ray tube according to claim 5, wherein said electron gun assembly includes:

three cathodes for respectively generating three electron beams;

first, second, third, fourth, fifth, sixth, seventh, and eighth grids each having through holes to let pass said three electron beams and arranged along a traveling direction of said electron beams;

a convergence cup having through holes formed at one end to let pass said three electron beams and having a common opening at the other end to let pass said three electron beams; and insulating supports for supporting said first to eighth grids and said convergence cup.

7. The color cathode ray tube according to claim 6, wherein said first, second, sixth, and seventh grids each include a thin plate-shaped electrode having electron-beam through holes to let pass said electron beams, said third, fourth, fifth, and eighth grids each include two bathtub-shaped electrodes having opening portions coupled together and each having a short axis perpendicular to a tube axis, and those of said bathtub-shaped electrodes of one of said fifth and eighth grids, which face each other, have a smaller outside length in a direction of said short axis than the openings of said bathtub-shaped electrodes of the other grid.

* * * * *